United States Patent [19]

Boucherie

[11] Patent Number: 4,935,640

[45] Date of Patent: Jun. 19, 1990

[54] OPERATING PROCEDURE FOR THE SUPPLY OF FIBRES TO BRUSH MANUFACTURING MACHINES AND A CONSTRUCTION WHICH APPLIES THIS PROCEDURE

[75] Inventor: Leonel Boucherie, Roeselare-Rumbeke, Belgium

[73] Assignee: Firma G.B. Boucherie, Izegem, Belgium

[21] Appl. No.: 317,592

[22] Filed: Mar. 1, 1989

[30] Foreign Application Priority Data

Mar. 2, 1988 [BE] Belgium ..... 8800237

[51] Int. Cl.[5] ..... A46D 1/055

[52] U.S. Cl. ..... 300/7; 300/21

[58] Field of Search ..... 300/2-11, 300/21

[56] References Cited

U.S. PATENT DOCUMENTS 4,688,857 8/1987 Boucherie ..... 300/7

FOREIGN PATENT DOCUMENTS 8700219 8/1988 Belgium .

0156332 2/1985 European Pat. Off. .

3607453 10/1987 Fed. Rep. of Germany .

*Primary Examiner*—Mark Rosenbaum

*Attorney, Agent, or Firm*—Foley & Lardner, Schwartz, Jeffery, Schwaab, Mack, Blumenthal & Evans

[57] ABSTRACT

Operating procedure for the supply of fibres to a brush manufacturing machine, more particularly to fibre containers of such machines, where one assumes wreathed or wrapped bundles, characterized in that it mainly consists in the grasping of the wreathing or wrapping (2) of a fibre bundle (1); at least separating a fibre bundle (1) into two parts (A-B); the cutting through of aforementioned wreathing or wrapping (2); the removal of the wreathing or wrapping (2) and the subsequent successive transport of the separated parts (A-B) to a fibre container (9) of a brush manufacturing machine.

18 Claims, 4 Drawing Sheets

31
20
8
32
30
1
33
2
2
11
4
13
5
6
12
15
10
16
18
21
14
22
24
17
25
22
20
P3
26
27
19
7
28
29
23
F4
F3
F1
F2

OPERATING PROCEDURE FOR THE SUPPLY OF FIBRES TO BRUSH MANUFACTURING MACHINES AND A CONSTRUCTION WHICH APPLIES THIS PROCEDURE

This invention relates to an operating procedure as well as a construction for the automatic supply, of fibres to a brush manufacturing machine.

This invention especially refers to an operating procedure and construction for the supply of natural fibres, coir in particular, to a machine manufacturing brushes produced from conventionally packed fibres.

It is known that natural fibres, such as coir, are packed in bundles by means of appropriate tying, wreathing or wrapping means. such as string, ropes or similar which in the case of coconut fibres can be formed of coir.

The knots formed by the knotted extermities of such strings, ropes or similar are, as known, pushed between the fibres to avoid loosening of the package, during transport among others.

It is clear that when the ultimate cutting of these ropes occurs for brush manufacturing the aforementioned knots remain stuck between the fibres which hampers the removal of the cut fibres inasmuch as first an aforementioned knot must be turned out of avoid the mixing up of the fibres.

Likewise it is known that the natural fibres in such a package are not parallel to one another so as that each bundle, after the loosening up of the tying means, cannot be placed as such into the fibre container of a brush manufacturing machine since a regular delivery of fibres by the bundle pick-up cannot be guaranteed as such.

In the assembly of, for instance, a bundle of coir these fibres are placed to form a layer, whereupon this layer is being rolled up. It is clear that due to this due to this often irregular rolling up movement the fibres can be positioned in a relatively quite shifted position with respect to each other and can consequently become entangled. During the manual input of aforementioned fibres in a fibre container this problem can be solved by unrolling the bundle of fibres after having untied the tying means prior to putting them in the fibre container of the machine.

Solutions have already been suggested for the supply of fibres to brush manufacturing machines where the fibres are being inserted in a tied or rolled up condition followed by the automatic cutting of the tying means and the removal thereof in order to eventually be submitted to specific operations prior to be inserted in the fibre container of an aforementioned machine.

In the Belgian Patent Application No. 8700219 a solution to the aforementioned problem has been suggested.

This consists mainly in that the tying means of the fibre bundle are being cut followed by the fibre's treatment, for instance combing out, to further transport the fibre to the fibre container.

Although this solution is quite effective, it concerns a rather complicated construction where in particular cases many fibres are damaged which is fact have to be removed as waste which means an important loss of fibres.

Another solution has already been suggested in the German patent application No. 3607453.

In this case each fibre bundle is being caught at one extremity after which the tying means which contain the bundle, after the cutting through of the bundle, are pushed off in the longitudinal direction of the fibres.

At the same time this patent application describes means to separate the fibres from each other. These means consist of a moulded channel which is being pushed into the mass of fibres to separate then along with the fibres drop off.

This solution is barley effective considering that while being piushed off tying means are pulled along on the one hand and that the fibres are getting mixed when dropping down the channel on the other hand.

Moreover the fibres drop, after the removal of the tying means, freely on a slide which transports them to aforementioned channel which is another reason as well that fibres could get mixed up.

The subject of present invention encompasses an operating procedure and a construction for the automatic opening of natural fibre bundles, on the one hand, and the separation into the parts of these bundles for the appropriate supply of such to a fibre container, on the other hand, in which way the disadvantages common to existing systems are systematically being excluded.

The operating procedure according to the invention mainly consists in catching the wreathing or wrapping means of a fibre bundle; in separating the fibre bundle in at least two parts; in cutting the aforementioned wreathing or wrapping means; in the removal of the wreathing or wrapping means and the subsequently consecutive supply of the separated parts to a fibre container of a brush manufacturing machine.

Present invention also relates to a construction which applies the aforementioned operating procedure and consists mainly of supporting means for a bundle; catching means which can be placed behind the wreathing or wrapping of a bundle and retaining such: means to be inserted into a bundle in order to split it up in at least two parts; means which catch and retain these separated parts; and means which cut the wreathing or wrapping loose, after which the catching means remove the wreathing of wrapping at an angle with respect to the longitudinal direction of the bundle and the means to transport the separated parts individually to a fibre container.

In order to achieve better understanding of the characteristics of the invention, a preferable embodiment is described hereafter by way of example, but without any limitation, whereby reference is made to the accompanying drawings, in which.

Figure 15:
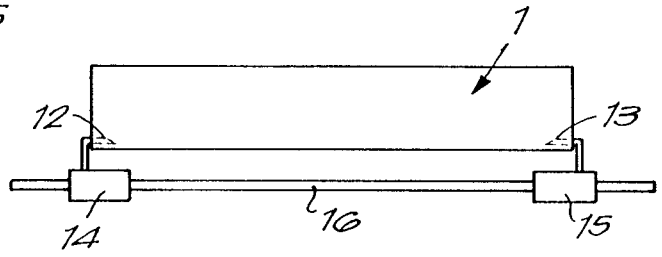
Figure 3:
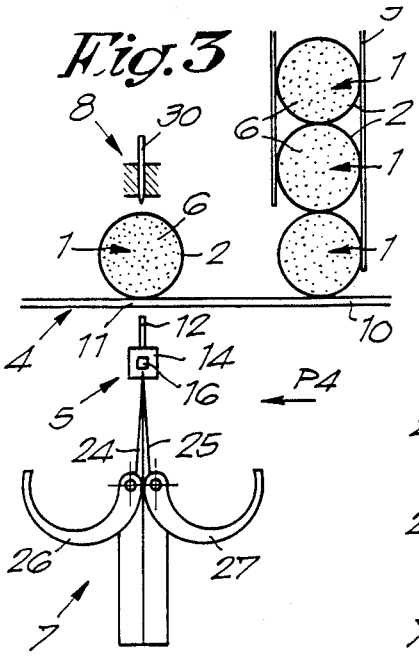
FIG. 3 is a schematic view according to arrow P3 in FIG. 2.
Figure 4:
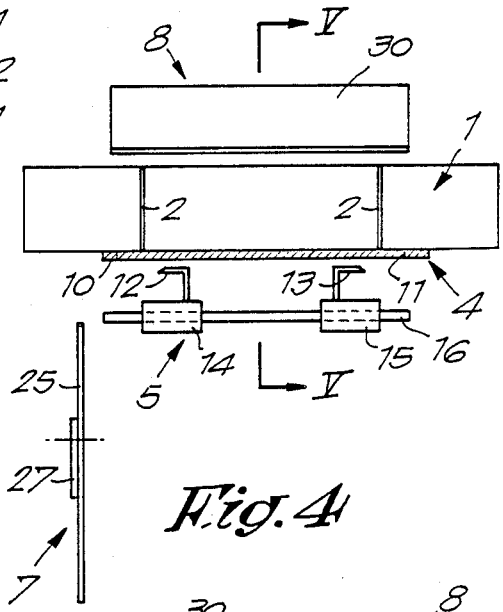
FIG. 4 is a view according to arrow P4 in FIG. 3.
Figure 5:
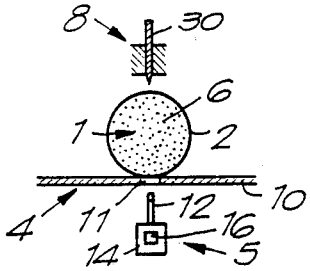
FIG. 5 is a cross section according to line V—V in FIG. 4.
Figure 6:
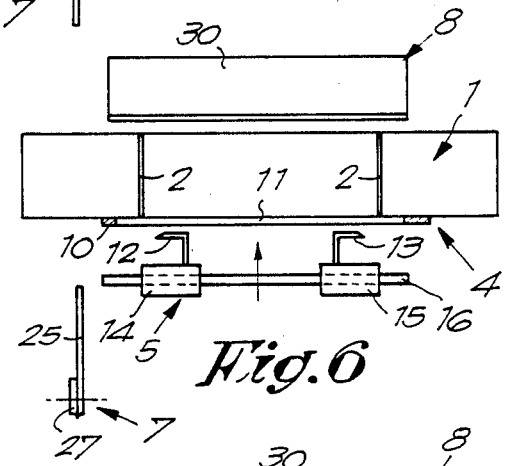
Figure 7:
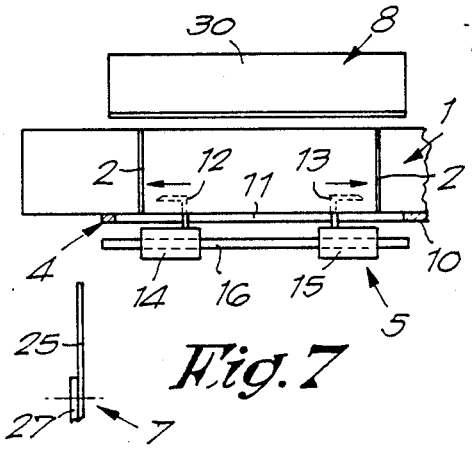
Figure 8:
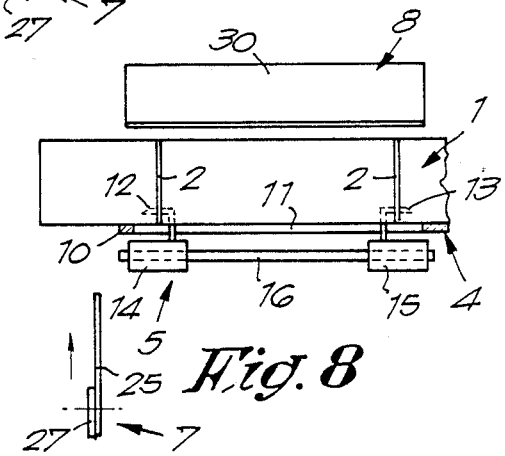
Figure 9:
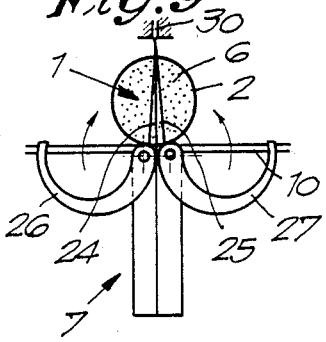
Figure 10:
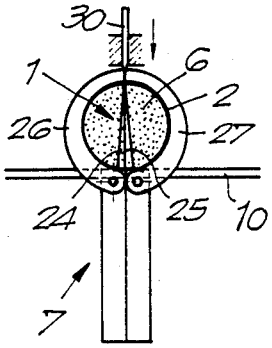
Figure 11:
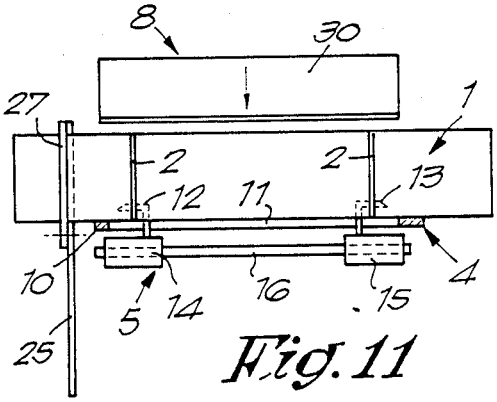
Figure 12:
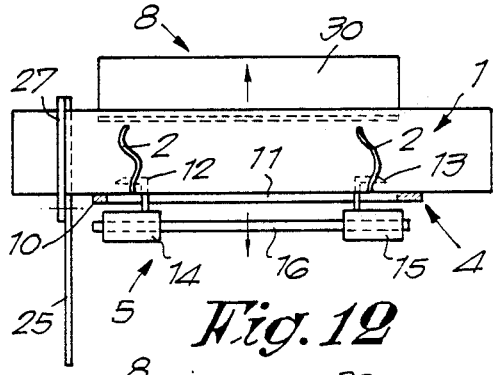
Figure 13:
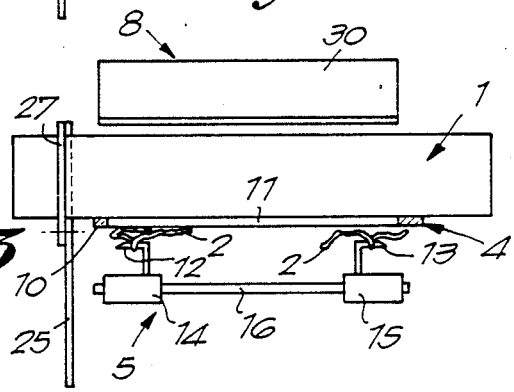
Figure 14:
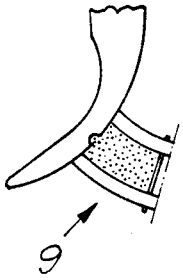
Figure 14:
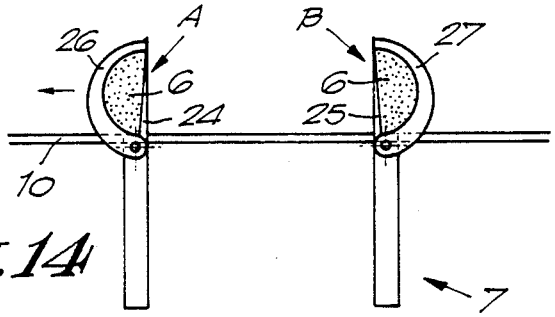

FIGS. 6, 7 and 8 being views similar to those of FIG. 4 but for successive steps;

FIGS. 9 and 10 being views, particularly similar to that in FIG. 3 but for successive steps;

FIG. 11 is a view according to following arrow P11 in FIG. 10;

FIGS. 12 and 13 being views similar to that in FIG. 11 but for successive steps;

FIG. 14 schematically represents the subdivided supply of the fibres to a fibre container;

FIG. 15 represents a view similar to that of FIG. 11, but for a bundle with wrapping.

Figure 1:
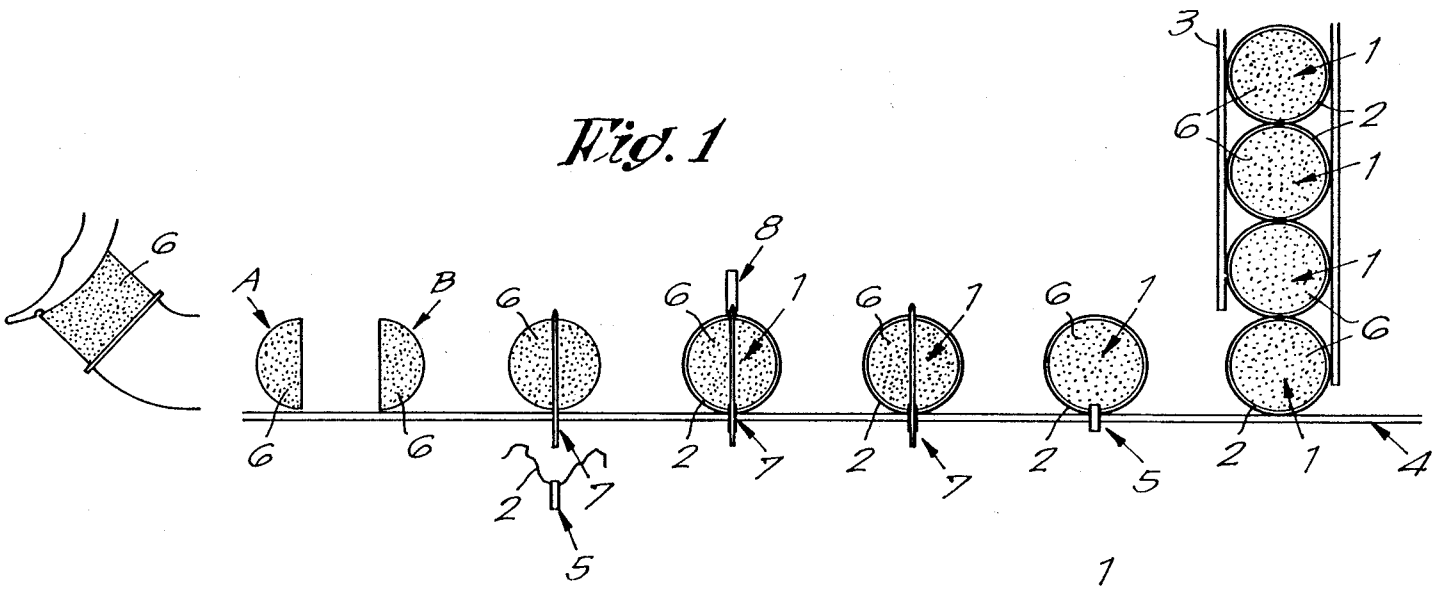
FIG. 1 represents a schematic arrangement of the operating procedure applied to the invention.

FIG. 1 represents schematically the operating procedure according to the invention.

It consists in that, in an appropriate manner, packed natural fibre bundles 1, for instance, coir, which are being kept together in a known way by means of twines of coir 2, are being supplied to a container 2 from which these bundles can be transported one by one in an appropriate manner, for instance by a transporting device or similar 4.

Subsequently to this transport, devices 5 are provided for which intrude between the fibres 6 of the bundle 1 and which then hook up behind the twines 2.

During a subsequently step bundle 1 is being separated, in this case, in two parts by devices 7.

The twines 2 are further being cut by means of a knife 8.

Furthermore the devices 5 are being removed from the bundle 1 which causes the twines 2 to be removed.

Finally both bundle 1 parts A and B seaprated by the devices 7 are being transported separately to the fibre container 9 of the brush manufacturing machine.

It is clear that in this manner one achieves that the wrapping of initially packed bundles of fibre is automatically being removed and that the bundle is being separated into at least two parts which are supplied individually to the machine.

It is herewith to be noted that the twines 2 are being removed in a direction perpendicular with respect to the fibres 6 in such way that the mixing up of fibres and or pulling of fibres out of the bundle are being avoided while at the same time the fibres are being supplied to the machine in smaller quantities.

Figure 2:
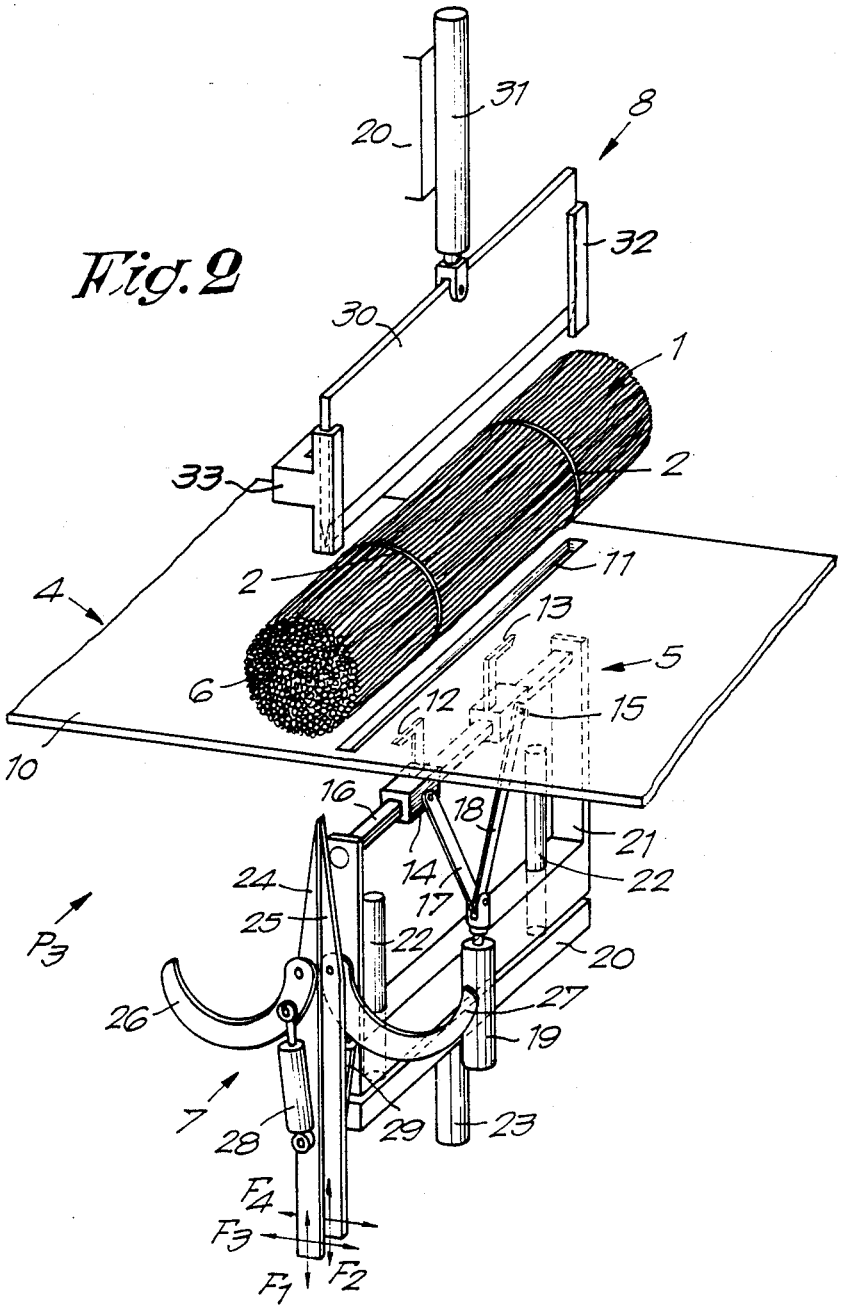
FIG. 2 is a prespective and schematically represents an embodiment which applies the the invention's operating procedure.

FIG. 2 represents an embodiment which applies aforementioned operating procedure.

This mainly consists of a table equipped witrh a slot 11 over which a fibre bundle 1 is being positioned. This table is comparable to the transporting device in FIG. 1.

The devices 5 are in this case formed by the two hooks, repsectively 12, 13 which are for instance each fixed to a bushing 14, 15 which can be slid over s shaft 16 by means of rods 17, 18 which are activated by a pressure cylinder 19 the body of which is being secured by a frame 21.

The shaft 16 is in this case secured in a frame 21 slidable along guide shafts 22, fixed on aforementioned frame 20, where the frame is being activated by a pressure cylinder 23, the body of which is being secured to frame 20.

The length of slot 11 is shorter than the length of a bundle 1 but longer than the distance between the twines 2, while the width of the table 10 is also smaller than the length of a bundle so that latter's extremities protrude from the edge of table 10.

The devices 7 to separate a bundle 1 in two consist in this example of two splitting devices 24, 25 which show a pointed free extremity and which are being placed right next to each other in which the splitting devices 24, 25 can be moved on one hand, in an appropriate manner not shown in the drawings, according to arrows F1 and F2 and, on the other hand, according to arrows F3 and F4.

Each of the splitting devices 24, 25 is equipped with a hinged jaw, respectievly 26, 27, which is being moved by for instance pressure cylinders 28, 29, of which the bodies are secured to the matching splitting devices 24, 25.

Finally a knife 30 is disposed over bundle 1 which is activated for instance by a pressure cylinder 31 which is secured to the frame 20, where this knife can be guided in guide channels 32, 33.

FIGS. 3 through 14 explain further the operating procedure given in accordance with the example in FIG. 2.

In FIG. 3 a bundle 1 has been moved out of the container 3 over the hooks 12, 13. These hooks 12, 13 will subsequently be moved upwards by the operation of the pressure cylinder 23 in such way that the hooks 12, 13 will be guided through the slot 11 between the twines 2 (see FIG. 7) after which, due to the operation if the pressure cylinder 19, the hooks 12, 13 will be located behind the twines 2 (see FIG. 8).

When the bundle 1 is thus secured by the hooking operation behind the twines 2 the splitting devices 24, 25, at the side of the table 10 wil be inserted in subject bundle 1 by the appropriate movement of theses device 24, 25 (FIG. 9) according to arrows F1 and F2 after which, by the operation of pressure cylinders 28 and 29 the jaws 26 and 27 are being closed, respectively around the parts A and B (FIG. 10), around the bundle 1.

At this moment the pressure cylinder 31 can appropriately be put into operation so that the knife 30 cuts through the twines 2 (see FIG. 12).

When the pressure cylinder 23 is subsequently being operated in reverse one achieves that the hooks 12 and 13 are being moved diagonally away from the bundle 1, which results in removal of the twines 2 through the slot 11 (see fig. 13).

Bundle 1 consists at this moment of loose fibres 6 which are being separated into parts A and B.

From FIG. 14 it appears that subsequently parts A and B, which are each caught, respectively in devices 24, 26 and 25, 27 can be supplied individually to a fibre container 9. It is clear that in a similar way the parts A and B of the bundle can be further divided individually.

Notwithstanding the fact that in the preceding description the splitting devices 24, 25 cooperate with the extremity of a fibre bundle 1 it is clear that such a cooperation can occur at any location on the bundle, for instance in the middle of it, where it is evident that in that case the hooks 12, 13 shall have to move along separate shafts 16 and that the table 10 as well as the knife 30 shall have to be separated in two parts.

In previous description the separation of the bundle into parts occurs prior or during the cutting of the wreathing. It is evident that the separation can occur for instance after the cutting of the wreathing.

In this description the packing is always described as a wreathing 2 in the form of a twine.

Of course, the invention may also advantageously be used with fibre pundles which are tied with a wrapping, for instance in the form of a paper wrapping. In this case the hooks 12, 13 (see FIG. 15) will be turned around, in other words, with their free extremities directed to each other in order to catch the wrappings at its extremities by inserting the hooks. In this case it is obvious that the table 10, the knife 30 and the splitting devices 24, 25 will as well be adequately adapted.

It is evident that present invention is in no means limited to the embodiment described above and illustrated by this accompanying drawings.

What is claimed is:

1. A method of supplying natural fibres to a brush manufacturing machine, comprising:

supplying a packaged bundle of fibres having a longitudinal direction and a radial direction;

grasping the packaging of the packaged bundle;

splitting the bundle into at least two parts;

clasping said at least two parts of the bundle;

cutting the packaging from said clasped parts;

removing the packaging from said clasped parts; and supplying each of said at least two clasped parts to a fibre container of said brush manufacturing machine.

2. The methood according to claim 1, further comprising between said clasping and supplying steps separating said at leat two clasped parts.

3. The method according to claim 1, wherein said grasping and removing steps are performed by two hooks which point away from each other to engage the packaging.

4. The method acording to claim 1, wherein said grasping and removing steps are performed by two hooks which point toward each other to engage respective ends of the packaging.

5. The method according to claim 4, wherein said removing step is performed by a relative movement of said hooks with respect to the bundle in a direction which forms an angle with the longitudinal direction of the bundle.

6. The method according to claim 5, wherein said angle is an acute angle.

7. The method according to claim 1, wherein said cutting step is perfomed radially with respective to the packaged bundle.

8. The method according to claim 1, wherein said splitting and clasping steps are performed at a longitudinal end portion of the bundle.

9. The method according to claim 1, wherein said splitting and clasping steps are performed at a central portion of the bundle.

10. An apparatus for supplying natural fibres to a brush manufacturing machine, comprising:

means for suppplying a packaged bundle of fibres having a longitudinal axis and a radial axis;

means for grasping the packaging of the packaged bundle;

means for splitting the bundle into at least two parts;

means, cooperating with said splitting means, for clasping said at least two parts of the bundle;

means for cutting the packaging from said clasped parts;

means, connected to said grasping means, for removing the packaging from said clasped parts; and means for supplying each of said at least two clasped parts to a fibre container of said brush manufacturing machine.

11. The apparatus according to claim 10, wherein said grasping means comprises a pair of hooking devices which point towards each other.

12. The apparatus according to claim 11, wherein said removing means move said hooks away from the packaged bundle at and with respect to the longitudinal axis of the bundle.

13. The apparatus according to claim 12, wherein said angle is an acute angle.

14. The apparatus according to claim 10, wherein said grasping means comprises a pair of hooking devices which point away from each other.

15. The apparatus according to claim 10, wherein said splitting means comprises a pair of knives which cut along substantially the same line and said clasping means comprises a pair of jaws, each jaw connected and cooperating with a respective one of said pair of knives to hold a respective part of the bundle therebetween.

16. The apparatus acording to claim 15, wherein said clasping means and said splitting means are located at a longitudinal end of the packaged bundle.

17. The apparatus according to claim 15, wherein said clasping and said splitting means are located along a central portion of the packaged bundle.

18. The apparatus according to claim 10, wherein further comprising a table for supporting the packaged bundle of fibres, said table having at least one slot disposed therin, over which said bundle may be placed and through which said packaging means may extend to grasp the packaging of the packaged bundle.

* * * * *